United States Patent [19]

Igaki et al.

[11] Patent Number: 4,792,318

[45] Date of Patent: Dec. 20, 1988

[54] DEVICE FOR WARM PRESS FORMING A PLATE-LIKE MEMBER INTO A SHADOW MASK FOR A COLOR CATHODE RAY TUBE

[75] Inventors: Masanori Igaki, Himeji; Sigeo Yoneyama, Yokosuka; Yoshimichi Hori, Yokohama; Takayuki Satoh, Chigasaki, all of Japan

[73] Assignee: Kabushiki Kaisha Toshiba, Kawasaki, Japan

[21] Appl. No.: 49,968

[22] Filed: May 15, 1987

[30] Foreign Application Priority Data

May 19, 1986 [JP] Japan ..... 61-114199

[51] Int. Cl.[4] ..... H01J 9/46

[52] U.S. Cl. ..... 445/66; 445/68

[58] Field of Search ..... 445/66, 68; 100/92, 100/93 P; 219/243

[56] References Cited

U.S. PATENT DOCUMENTS

| | | | |
|---|---|---|---|
| 3,096,545 | 7/1968 | Rowland | 100/92 |
| 3,754,499 | 8/1973 | Heisman | 100/93 P |
| 3,775,588 | 11/1973 | Niehenke | 219/243 |
| 4,557,792 | 12/1985 | Yamada | 100/93 P |
| 4,645,559 | 2/1987 | Kaiser | 100/93 P |

FOREIGN PATENT DOCUMENTS

| | | | |
|---|---|---|---|
| 60220437 | 2/1972 | Japan . | |
| 61-86032 | 1/1985 | Japan . | |
| 0080736 | 4/1986 | Japan | 445/68 |
| 0131338 | 6/1986 | Japan | 445/68 |

*Primary Examiner*—Kurt Rowan

*Attorney, Agent, or Firm*—Oblon, Fisher, Spivak, McClelland & Maier

[57] ABSTRACT

A device for warm press forming a plate-like member into a shadow mask for a color cathode ray tube comprises a mold for applying pressure to the plate-like member, including a heated inner section and an outer section, and insulation means between the inner and outer sections for reducing heat transmission from the inner section to the outer section for increasing the thermal efficiency of the device.

1 Claim, 3 Drawing Sheets

DEVICE FOR WARM PRESS FORMING A PLATE-LIKE MEMBER INTO A SHADOW MASK FOR A COLOR CATHODE RAY TUBE

BACKGROUND OF THE INVENTION

This invention relates to a mask-forming device for forming a shadow mask of a color cathode ray tube, and more particularly to such a device using warm press forming.

In general, a color cathode ray tube has a built-in shadow mask with a color selection function within an envelope having a panel. Three electron beams for red, green and blue generated by the electron gun pass through minute apertures arranged precisely on the mask. As a result, the beams correctly strike the red, green and blue light-emitting phosphor deposited inside the panel, causing it to phosphoresce and produce a color image.

It is important in the mask that the minute apertures be precisely etched, and that the mask be formed to a precise curvature along the inside surface of the panel without any deformation. However, only one third or less of the total electron beams actually pass through the apertures of the mask, the rest striking and heating the mask.

In the prior art, aluminium-killed decarbonized steel generally has been used as the material for the mask. The coefficient of heat expansion of the aluminium-killed decarbonized steel is relatively high, and thus, it expands with heat and deforms, causing the beams passing through the apertures to be misaligned on the phosphor. In order to resolve this problem it has been suggested, as shown in Japanese Patent Publication No. 42-25446, that the mask be made of a material with a low thermal coefficient of expansion with heat, such as invar.

However when using invar alloy, which consists mainly of nickel-steel alloys, as the mask material, the yield point, which has a great effect on the mask-forming process, is 29–30 kg/mm$^2$, as shown in Japanese Patent Laid-Open No. 59-200721. This is high compared with the yield point for aluminium-killed decarbonized steel, which is approximately 20 kg/mm$^2$. Thus when forming a mask using a thin plate member of invar, with its high proportion of nickel-steel alloys, it is extremely difficult in a rectangular-shaped shadow mask to correctly form by press-forming alone, both a curved main section with a large number of apertures, and a rectangular skirt section. This is due to the spring-back tendency of invar plate after press forming.

However a distortion-free mask of high precision, which is made of a thin plate of invar alloy, can be obtained by warm press forming after aperture-etching and annealing, to lower the yield point. Warm press forming is a forming process whereby of a thin metal plate member is heated to a temperature lower than that of the recrystallization temperature of the plate member during plastic working.

However the above warm press forming is carried out with a press, and heating causes problems due to heat expansion of the forming device itself.

In carrying out warm press forming, electric heaters are built into at least the punch, the clamp, the knockout and the die of a press mold in order to heat the thin plate member as it is being pressed. In such a case, there may be a temperature difference between the die and its associated spacers, which confine the downward movement of the die. This temperature difference creates a pitch difference between guide pins fixed to the spacers, and guide bushes fixed to the die. This pitch difference is due to the difference in heat expansion between the die and the spacer. This pitch difference will, in turn lead to seizure, thus making it difficult for the press mold to operate as required.

Heat is also transferred to sliders of the press machine, which are in contact with the press mold, and heat expansion occurs in these sliders, as well. Thus, there is a change in the clearance between the slider and a fixed guide which supports movement of the slider, making it difficult to maintain the required accuracy. This is particularly true when a press mold that has been heating up for some time is attached to a press machine, since the heat expansion in the slider is even greater, causing it to seize against the fixed guide.

Furthermore, the heat from the heated parts of the device is conducted widely to other unheated parts, resulting in a very low heat efficiency, and more energy than necessary for heating must be supplied.

As explained above, in the prior art, heat is conducted to all the other parts of the apparatus when the press mold is heated, and seizing and the like occur due to differences in heat expansion of the various parts. Thus, it is difficult to carry out the process smoothly, and excessive energy must be supplied, which makes the process uneconomic.

SUMMARY OF THE INVENTION

It is an object of this invention to provide a mask-forming device for forming a shadow mask of a color cathode ray tube which permits smooth operation and the required product precision even though the press mold is heated for warm press forming.

It is a further object of the invention to reduce heat transmission in a warm press forming device for increasing the thermal efficiency of the device.

Another object of the invention is to decrease deformation of parts of a warm press forming device due to thermal expansion.

A further object of the invention is to maintain a substantially uniform heat distribution on the surfaces of a warm press forming device which contact a shadow mask during its formation.

According to this invention, a device for warm press forming a plate-like member into a shadow mask for a color cathode ray tube comprises a mold for applying pressure to the plate-like member, including a heated inner section and an outer section, and insulation means between the inner and outer sections for reducing heat transmission from the inner section to the outer section for increasing the thermal efficiency of the device.

Preferably, the mold includes a die having a defined shape, a punch interacting with the die for molding the plate-like member into the defined shape, a clamp for holding the plate-like member during the forming process, and a knockout for removing the mask from the die.

It is also preferred that the inner section includes a heated portion of each of the die, the punch, the clamp and the knockout.

It is further preferred that the heated inner sections each includes heating means therein.

Heat is supplied for warm press forming to those sections of the press mold which contact the plate-like member. At the same time, heat is not conducted over a wide area thanks to the heat insulating member interposed at the division with the other parts. As a result there is no seizing of moving parts caused by differences in heat expansion due to heat being conducted over a wide area, the operation can smoothly run at all times, and the energy required for heating is reduced.

DETAILED DESCRIPTION OF THE PREFERRED EMBODIMENT

An embodiment of this invention now will be explained with reference to Figures.

Figure 1:
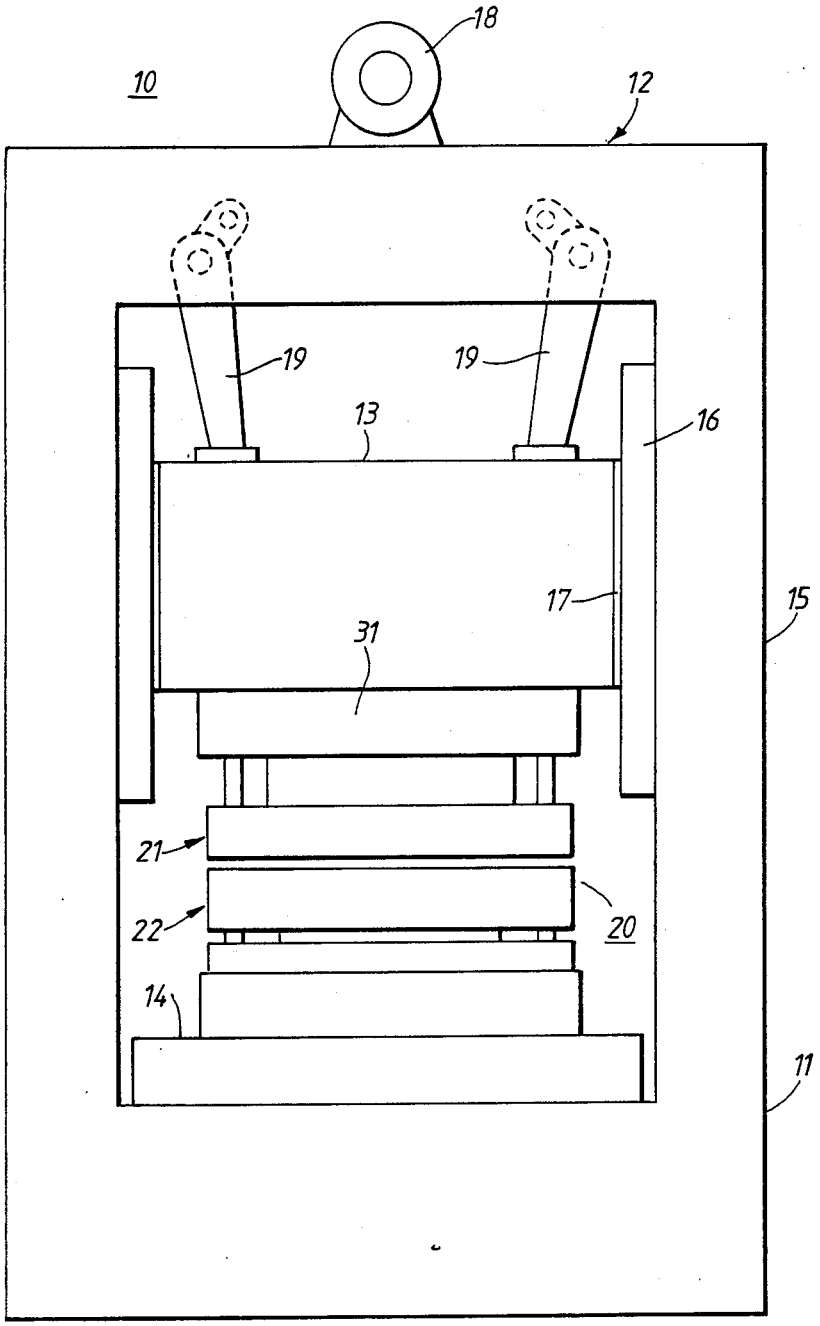
FIG. 1 is a schematic side view of a press machine having a mask forming device according to an embodiment of the invention.

In FIG. 1, a press machine 10 has a movable slide 13 and a fixed bolster 14 in a base 11, and a frame 12 supported on base 11. An upper mold 21 of a mask forming device 20 is mounted on slide 13, and a lower mold 22 is mounted on bolster 14. Fixed guides 16 are fixed to side frames 15 of frame 12, guiding slide 13 upwards and downwards along slide guides 17 of slide 13. Slide 13 is driven by a drive motor 18 via cranks 19.

Figure 2:
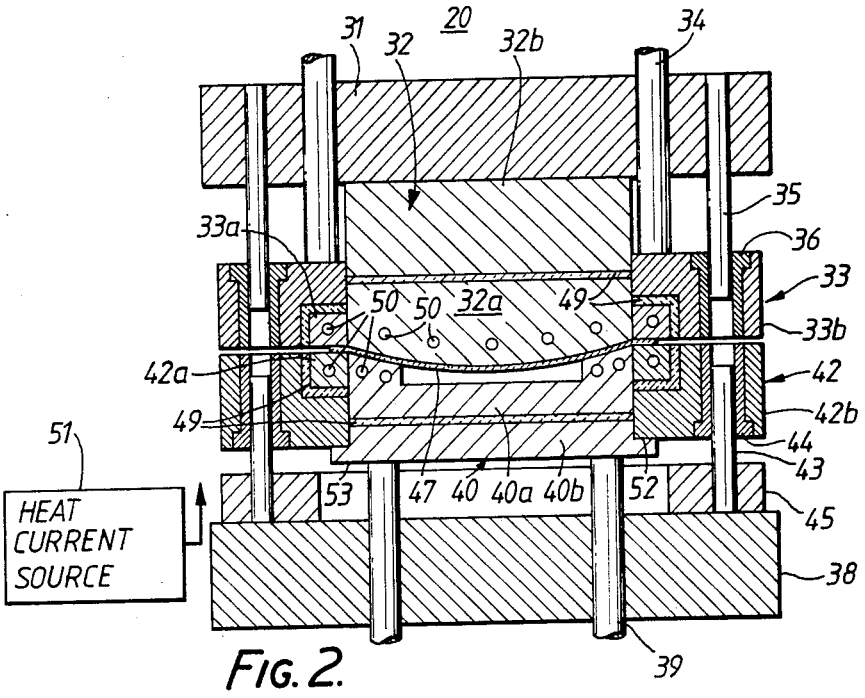
FIG. 2 is a cross-sectional view of the embodiment of the invention shown in FIG. 1.
Figure 3:
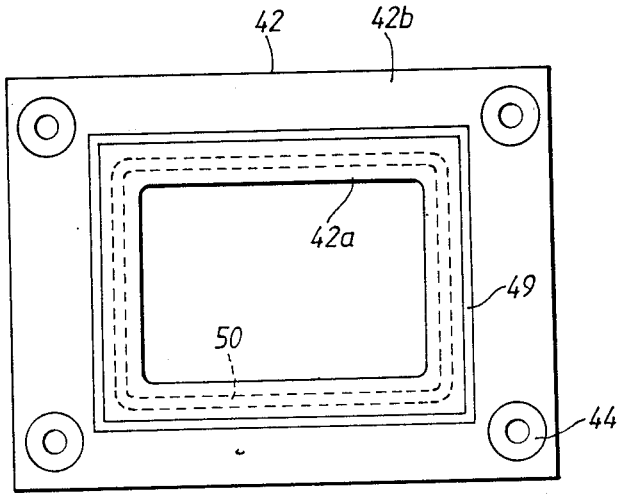
FIG. 3 is a plan view of a die of the embodiment of FIG. 2.

In FIGS. 2 and 3, the mask forming device 20 is shown. The device has an upper manifold 31, which is moved up and down by the slide 13. On the lower surface of upper manifold 31, a punch 32 is fitted. The upper mold 21 includes upper manifold 31 and punch 32. There is a clamp 33 around the outer edge of punch 32, which can be moved upward and downward. Parts denoted by the numeral 34 are upper pistons which are provided between upper manifold 31 and clamp 33, and move clamp 33 up and down. Guide pins 35 are fitted in a vertical direction from upper manifold 31 and mate with guide bushes 36 attached to clamp 33 to guide clamp 33 in its upward and downward motion.

A lower manifold 38 and a knockout 40 face punch 32, and move up and down by means of lower pistons 39. A die 42 surrounds the outer surface of knockout 40 and can move up and down along the knockout 40. The inside corner of the lower edge 52 of the die 42 engages with the protrusion 53 on lower edge of the outer face of knockout 40. In other words, the protrusion 53 on the lower edge of knockout 40 acts as a stop for the downward movement of die 42. The lower mold includes lower manifold 38, knockout 40 and die 42. Guide pins 43 are fitted with spacers 45 on top of lower manifold 38 which mate with guide bushes 44, attached to die 42, and guide die 42 as it moves up and down. Spacers 45 are mounted on top of lower manifold 38, and confine the downward movement of the die to specified limits.

Thin plate member 47, the material to be formed, typically consists of Fe-Ni alloy, i.e., invar alloy. After an aperture forming process, It is formed, after the aperture forming process, into a mask by the press mold which includes punch 32 and clamp 33, and the opposing knockout 40 and die 42. The thickness of the member 47 is about 0.2 mm or less, e.g., 0.12 mm.

In this embodiment, a division is made between the parts that make up the press mold, at minimum the punch 32, and clamp 33, and the opposing knockout 40 and the die 42.

Punch 32 is separately formed as a first punch section 32*a* in contact with the thin plate member 47, and a second punch section 32*b*, which does not contact the plate 47. Clamp 33 is formed into a first clamp section 33*a* in contact with thin plate member 47, and a second clamp section 33*b* which does not directly contact thin plate member 47. Knockout 40 is also formed in a first knockout section 40*a* in contact with thin plate member 47, and a second knockout section 40*b* which does not directly contact thin plate member 47. Finally, die 42 is formed in a first die section 42*a* in contact with thin plate member 47, and a second die section 42*b* which does not directly contact thin plate member.

At the division between these parts heat insulating member 49 is interposed. As above mentioned, the press mold is divided into a first or inner section in contact with the thin plate member, and a second or outer section in non-contact with the thin plate member. The first section of the mold, i.e., the respective first sections 32*a*, 33*a*, 40*a* and 42*a* of the mold parts is supported by the second section, i.e., the respective second sections 32*b*, 33*b*, 40*b* and 42*b* of the mold parts.

In addition, heating means 50, such as electric heaters, is provided to supply heat for the warm press forming those first sections which are in direct contact with the thin plate member 47, that is, sections 32*a*, 33*a*, 40*a* and 42*a*. The first sections 32*a*, 33*a*, 40*a* and 42*a* are preferably of the smallest possible size compatible with the size of the area which contacts the thin plate member, and the space necessary for a built-in electric heater. The first clamp section 33*a* and the first die section 42*a* may be split into two or more sections for greater ease of processing. The heat insulation 49 should be selected from materials which can withstand the required temperatures and will not greatly deform with the pressure of the press mold, e.g., press-formed glass wool.

Figure 4:
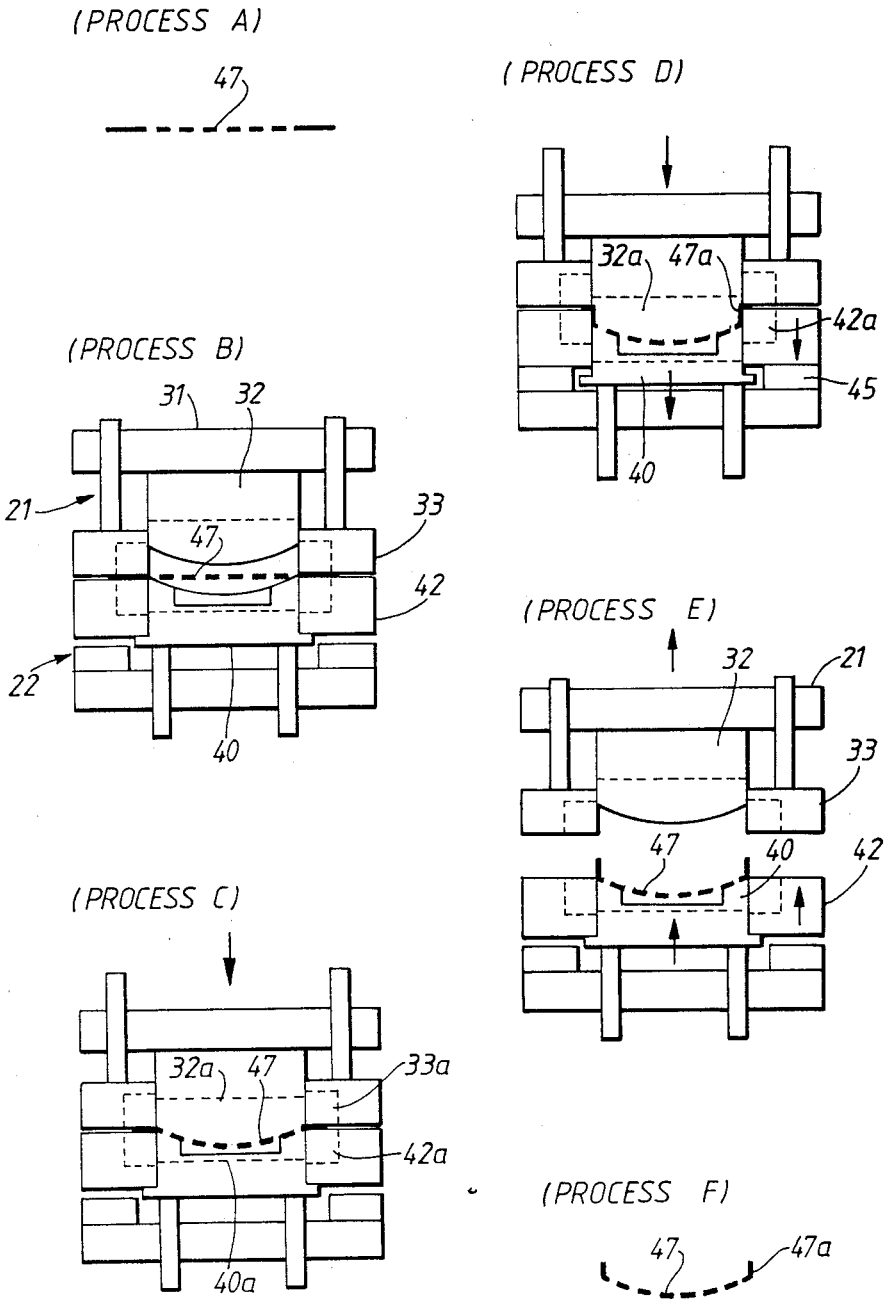
FIG. 4 is a process chart for explaining the operation of the invention.

Referring to FIGS. 2 to 4, the operation of the embodiment will be explained. The movement of parts is indicated with the arrows in FIG. 4.

When forming the thin plate member 47 into a mask, a thin plate member 47 with a large number of apertures is first prepared (Process A). Next, the thin plate member is inserted at the pressed position of the mold 21, 22, the upper manifold 31 is brought down, and the non-aperture periphery edge of thin plate member 47 is held fast between the clamp 33 and the die 42 (Process B). The main section of the thin plate member with its plurality of apertures is then pressed between the first punch section 32*a* and the first knockout section 40*a*, and is formed into a predetermined curved shape (Process C). In this situation, the die 42 comes down to and stops at top of the spacer 45, but the knockout 40 is pushed downward by the first punch section 32*a* of punch 33, so that the skirt section 47*a* of the mask is press-formed by the relation of the first die section 42*a* and the first punch section 32*a* (Process D). After that, upper manifold 31 goes up, and knockout 40 pushes up and removes the pressed plate 47 (Process E), thus completing the mask formation (Process F).

Here the first sections 32*a*, 33*a*, 40*a*, and 42*a* of the punch 32, the clamp 33, the knockout 40 and the die 42 are heated to the required temperature by their respective electric heaters 50, which are supplied with heating current from a heat current source 51, and then the thin plate member 47 is warm press formed.

However, the transfer of heat to other sections is reduced by the heat insulating member 49 placed at the divisions. For example, with the first die section 42*a* heated to 100° 1 C., the temperature of the second die section 42*b* of the die 42 can be held to 20° C.-30° C. As a result, seizing in the movement between the guide pins 43 in the guide-bushes 44 is prevented, and die 42 can be made to move correctly. The same is true for clamp 33.

In addition, as the temperature of the lower surface of the slider on the press machine connected to the press mold only rises to around 30° C., the previous problem of seizing between the slider and its fixed guide is prevented, and proper operation of the press can be ensured without loss of precision.

The pitch between the guide bushes is easily altered compared with that between the guide pins, in order that the guide bushes may be fixed to the temperature rise of the clamp. The difference between these pitches causes the seizure described previously.

For precise mask formation, it may be desired that the diameter difference, i.e., clearance of the guide bush and the guide pin, be less than 0.02 mm. The embodiment of the invention described above satisfies this clearance without seizure. As an example, when the pitch of the mold for a 15 inch type shadow mask was 500 mm and the thermal expansion coefficient was $11.7\times10^{-6}$/degree, the clearance was 0.017 mm.

Furthermore, when the mold is designed with due regard to the thermal expansion, the difference of temperature distribution in the mold also is less, thus maintaining high precision of the mask formation. Moreover, since the area heated under the warm press forming is from 1/5-1/10 of that in the prior art, the capacity of the electric heaters can be much smaller, with a consequent saving in energy. This also means that with a sufficient margin in the capacity of the heaters, the time taken to heat up to the required temperature can be shortened, and production efficiency thus can be improved. Experiments by the inventors showed that the time required for heating can be reduced by as much as 40 minutes to one hour, as compared with the conventional warm press forming device, which took two hours. Furthermore, as explained above, by keeping the size of the heated blocks to the minimum and minimizing the transfer of heat to the surroundings through the use of the heat insulating member 49, the heat loss is extremely small and temperature fluctuation during the heating period can be kept to a minimum. In experiments, such fluctuation was reduced from the previous 40° C.-50° C. to less that 20° C.

In the above embodiment an electric heater was used as the heating device, but it is also possible to circulate oil or other fluids in the sections to be heated. Press-formed glass wool was indicated as suitable for the heat insulating member 49, but it would also be possible to use other materials capable of withstanding the pressure of the press mold, such as compressed mica, asbestos, rock wool, or carbonized cork.

With this invention as described above, the dissipation of heat supplied for warm press forming is minimized, it being transferred substantially only to the member to be formed. Seizure of moving parts due to differentials in heat expansion is also reduced, and smooth operation is maintained. Furthermore the heat energy required to reach the required temperature is reduced, pressing can take place with shortened heating time and at a more uniform temperature, and production efficiency and product precision are improved.

Other variations and modifications can be made in the invention without departing from the scope or spirit of the invention.

What is claimed is:

1. A device for warm press-forming a plate-like member into a shadow mask for a color cathode ray tube comprising:

a mold for applying pressure to the plate-like member, including an upper mold section having a punch of a defined shape for pressing the plate-like member and a clamp for holding the plate-like member during the forming process, a lower mold section opposite to the upper mold section, having a die interacting with the punch for molding the plate like member into the defined shape, and a knockout for removing the mask from the die, each of the punch, clamp, die and knockout including a heated portion in contact with the plate-like member and a unheated portion;

a plurality of guide pins for slidably connecting the punch and clamp and for slidably connecting the die and knockout, said guide pins passing through said unheated portions of said clamp and said die;

insulation means between the heated portions and the unheated portions of the punch, clamp, die and knockout, respectively; and heating means in each of the heated portions.

* * * * *